US010781651B2

(12) United States Patent
Hern et al.

(10) Patent No.: US 10,781,651 B2
(45) Date of Patent: Sep. 22, 2020

(54) FRAC PLUG SYSTEM WITH INTEGRATED SETTING TOOL

(71) Applicants: Gregory Hern, Porter, TX (US); YingQing Xu, Tomball, TX (US)

(72) Inventors: Gregory Hern, Porter, TX (US); YingQing Xu, Tomball, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 92 days.

(21) Appl. No.: 16/195,282

(22) Filed: Nov. 19, 2018

(65) Prior Publication Data

US 2020/0157900 A1 May 21, 2020

(51) Int. Cl.
*E21B 23/01* (2006.01)
*E21B 23/04* (2006.01)
*E21B 33/129* (2006.01)

(52) U.S. Cl.
CPC ..... *E21B 23/01* (2013.01); *E21B 23/04* (2013.01); *E21B 33/1293* (2013.01)

(58) Field of Classification Search
CPC ..... E21B 23/065; E21B 23/01
See application file for complete search history.

(56) References Cited

U.S. PATENT DOCUMENTS 2,707,998 A * 5/1955 Baker ..... E21B 33/134 166/63
2,807,325 A * 9/1957 Webb ..... E21B 23/065 166/63
3,024,843 A * 3/1962 Hanes ..... E21B 23/065 166/63
3,977,473 A 8/1976 Page
5,024,270 A 6/1991 Bostick
5,027,270 A 6/1991 Bostick
7,017,672 B2 3/2006 Owen, Sr. et al.
9,528,342 B2 12/2016 Xu et al.
9,810,035 B1 11/2017 Carr et al.
10,443,331 B1 10/2019 Andres et al.
2004/0216868 A1 11/2004 Owen, Sr.
(Continued)

OTHER PUBLICATIONS

International Search Report and Written Opinion for Intnerional Application No. PCT/US2019/061914; International Filing Date Nov. 18, 2019; Report dated Mar. 16, 2020 (pp. 1-11).
(Continued)

*Primary Examiner* — David J Bagnell
*Assistant Examiner* — Dany E Akakpo
(74) *Attorney, Agent, or Firm* — Cantor Colburn LLP

(57) ABSTRACT

A downhole tool includes a setting cone having a body including an outer surface. The body has a first end, a second end and an intermediate portion. At least a portion of the body includes a taper at the second end. A passage extends through the body from the first end to the second end. An anchor is arranged at the second end. The anchor includes a first end section receptive of the setting cone and a second end section. A mandrel extends through the passage of the setting cone and the anchor. The mandrel includes a first end portion, a second end portion and an intermediate section. A bottom sub is arranged at the second end section of the anchor. The bottom sub includes a first member fixedly mounted to the mandrel and a second member that is shiftable relative to the mandrel.

20 Claims, 4 Drawing Sheets

(56) References Cited

U.S. PATENT DOCUMENTS

| | | | |
|---|---|---|---|
| 2005/0230100 | A1 | 10/2005 | Hirth et al. |
| 2010/0230116 | A1 | 9/2010 | Harmon et al. |
| 2013/0186649 | A1 | 7/2013 | Xu et al. |
| 2014/0041857 | A1 | 2/2014 | Xu et al. |
| 2014/0190685 | A1 | 7/2014 | Frazier et al. |
| 2015/0129203 | A1 | 5/2015 | Deutch et al. |
| 2016/0290093 | A1 | 10/2016 | Doane et al. |
| 2018/0016859 | A1 | 1/2018 | Stair et al. |
| 2018/0051532 | A1 | 2/2018 | Smith et al. |
| 2020/0157913 | A1 | 5/2020 | Hern |
| 2020/0157915 | A1 | 5/2020 | Hern et al. |

OTHER PUBLICATIONS

International Search Report and Written Opinion for Intnerional Application No. PCT/US2019/061806; International Filing Date Nov. 15, 2019; Report dated Mar. 11, 2020 (pp. 1-10).

International Search Report and Written Opinion for Intnerional Application No. PCT/US2019/061911; International Filing Date Nov. 18, 2019; Report dated Mar. 12, 2020 (pp. 1-11).

* cited by examiner

FRAC PLUG SYSTEM WITH INTEGRATED SETTING TOOL

BACKGROUND

In the resource exploration and recovery industry, boreholes are formed to test for and recover formation fluids. During testing and extraction, various tools are deployed into the borehole. A frac plug may be set against a casing and used as part of a process that initiates a fracture in a formation. Setting a frac plug, or other seal may require the use of drop balls, explosive charges, or other tools that increase an overall cost and complexity of operation.

Typically, a force, which may be initiated by the explosive charge, may urge a setting member into a seal. After the frac plug is set, guns are fired to perforate the casing. Pressure may then be applied to a drop ball causing fluids to pass through perforations to create a fracture in the formation. Plugging and perforating the casing and fracturing the formation includes multiple steps. Accordingly, the art would be receptive of alternative methods for setting seals/plugs in a borehole.

SUMMARY

Disclosed is a downhole tool comprising: a setting cone including a body having an outer surface, the body having a first end, a second end and an intermediate portion, at least a portion of the body including a taper at the second end, a passage extending through the body from the first end to the second end; an anchor arranged at the second end of the setting cone, the anchor including a first end section receptive of the setting cone and a second end section; a mandrel extending through the passage of the setting cone and the anchor, the mandrel including a first end portion, a second end portion and an intermediate section, a conduit extends from the first end portion toward the second end portion, an opening extends from the conduit through the mandrel; and a bottom sub arranged at the second end section of the anchor, the bottom sub including a first member fixedly mounted to the mandrel and a second member that is shiftable relative to the mandrel.

Disclosed is a downhole tool including a setting cone having a body including an outer surface. The body has a first end, a second end and an intermediate portion. At least a portion of the body includes a taper at the second end. A passage extends through the body from the first end to the second end. An anchor is arranged at the second end of the setting cone. The anchor includes a first end section receptive of the setting cone and a second end section. A mandrel extends through the passage of the setting cone and the anchor. The mandrel includes a first end portion, a second end portion and an intermediate section. A conduit extends from the first end portion toward the second end portion. An opening extends from the conduit through the mandrel. A bottom sub is arranged at the second end section of the anchor. The bottom sub includes a first member fixedly mounted to the mandrel and a second member that is shiftable relative to the mandrel.

Also disclosed is a resource exploration and recovery system including a first system, and a second system fluidically connected to the first system through a wireline. The wireline supports a downhole tool including a setting cone having a body including an outer surface. The body has a first end, a second end and an intermediate portion. At least a portion of the body includes a taper at the second end. A passage extends through the body from the first end to the second end. An anchor is arranged at the second end of the setting cone. The anchor includes a first end section receptive of the setting cone and a second end section. A mandrel extends through the passage of the setting cone and the anchor. The mandrel includes a first end portion, a second end portion and an intermediate section. A conduit extends from the first end portion toward the second end portion. An opening extends from the conduit through the mandrel. A bottom sub is arranged at the second end section of the anchor. The bottom sub includes a first member fixedly mounted to the mandrel and a second member that is shiftable relative to the mandrel.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
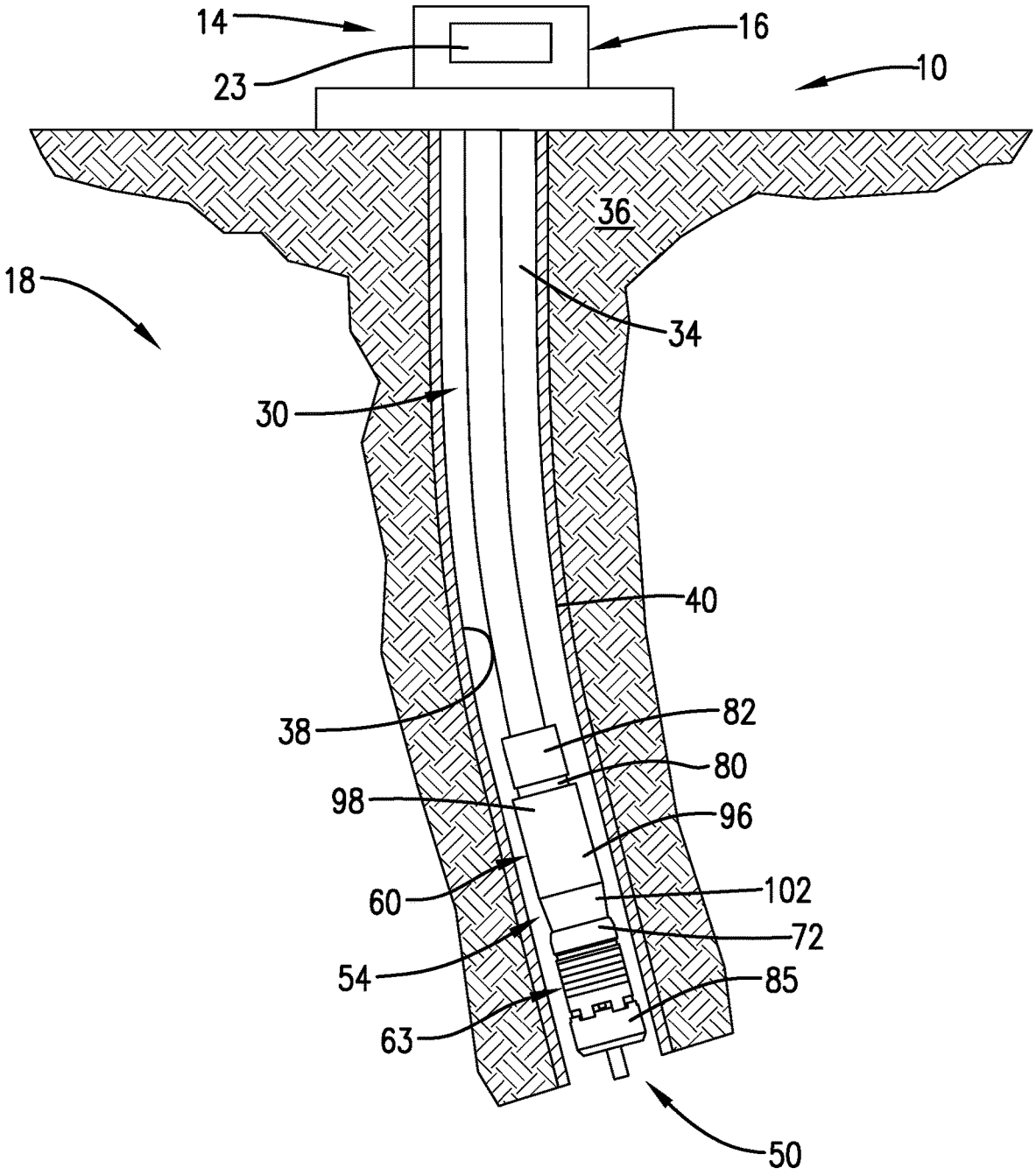
FIG. 1 depicts a resource exploration and recovery system including a frac plug system having an integrated setting tool, in accordance with an aspect of an exemplary embodiment.

A resource exploration and recovery system, in accordance with an exemplary embodiment, is indicated generally at 10, in FIG. 1. Resource exploration and recovery system 10 should be understood to include well drilling operations, completions, resource extraction and recovery, $CO_2$ sequestration, and the like. Resource exploration and recovery system 10 may include a first system 14 which, in some environments, may take the form of a surface system 16 operatively and fluidically connected to a second system 18 which, in some environments, may take the form of a subterranean system.

First system 14 may include a control system 23 that may provide power to, monitor, communicate with, and/or activate one or more downhole operations as will be discussed herein. Surface system 16 may include additional systems such as pumps, fluid storage systems, cranes and the like (not shown). Second system 18 may include a tubular string or wireline 30 that extends into a wellbore 34 formed in a formation 36. Wireline 30 may be operatively connected to control system 23. Wellbore 34 includes an annular wall 38 which may be defined by a surface of formation 36, or a casing tubular 40 such as shown.

Figure 2:
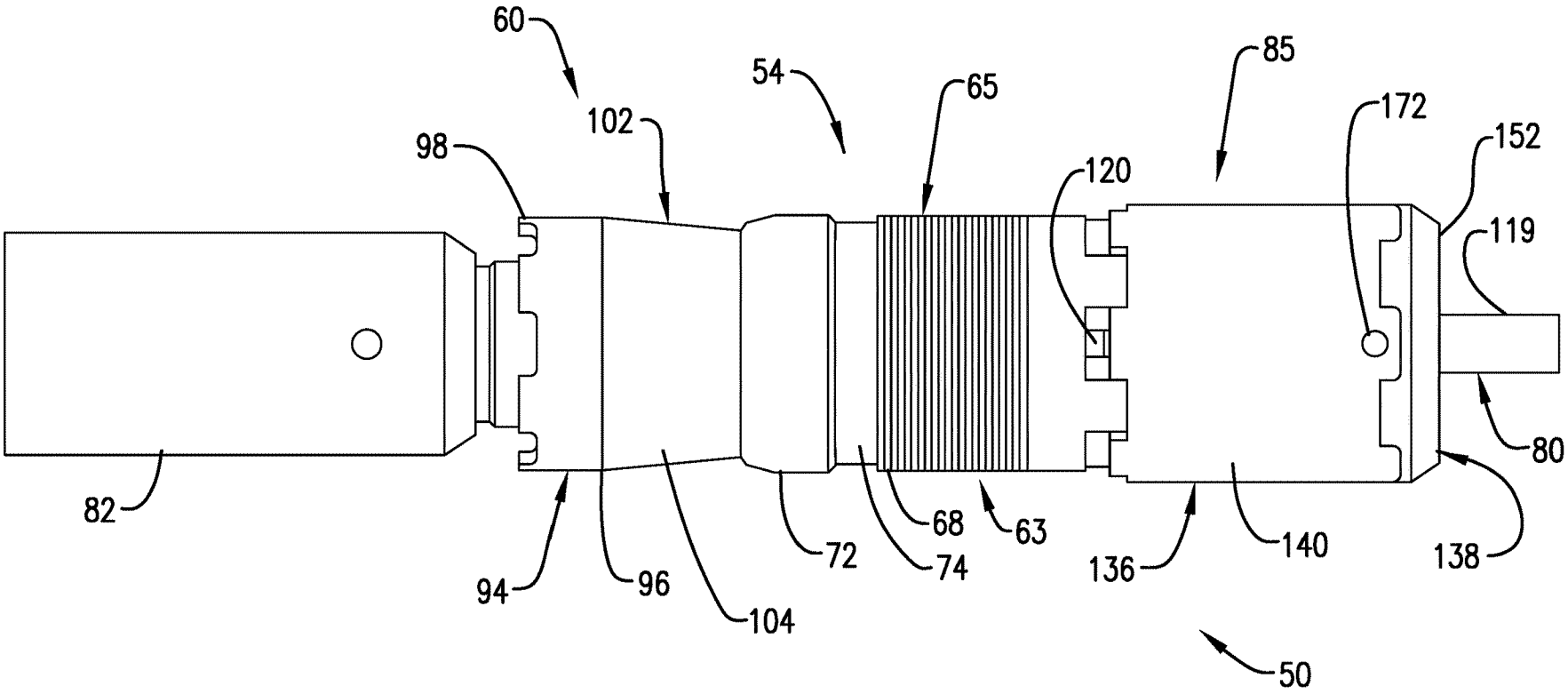
FIG. 2 depicts the frag plug system of FIG. 1, in accordance with an aspect of an exemplary embodiment.

In an exemplary aspect, wireline 30 supports a downhole tool 50. As will be detailed herein, downhole tool 50 may take the form of a frac plug system 54 that may be selectively engaged with annular wall 38. Referring to FIG. 2, and with continued reference to FIG. 1, frac plug system 54 includes a setting cone 60 that may force an anchor 63 into engagement with annular wall 38. Anchor 63 may take the form of a slip 65 having a plurality of wickers 68. Wickers 68 "bite" into annular wall 38 when slip 65 moves along setting cone 60. Anchor 63 includes a first end section 69 that receives setting cone 60 and a second end section 70. Setting cone 60 also supports a seal 72 and a backup ring 74. Backup ring 74 urges seal 72 along setting cone 60. Seal 72 may seal against annular wall 38.

A mandrel 80 extends through setting cone 60 and supports an actuator head 82. Mandrel 80 also extends through a bottom sub 85. As will be detailed herein, actuator head 82 establishes a force that drives anchor 63 along setting cone 60.

Figure 3:
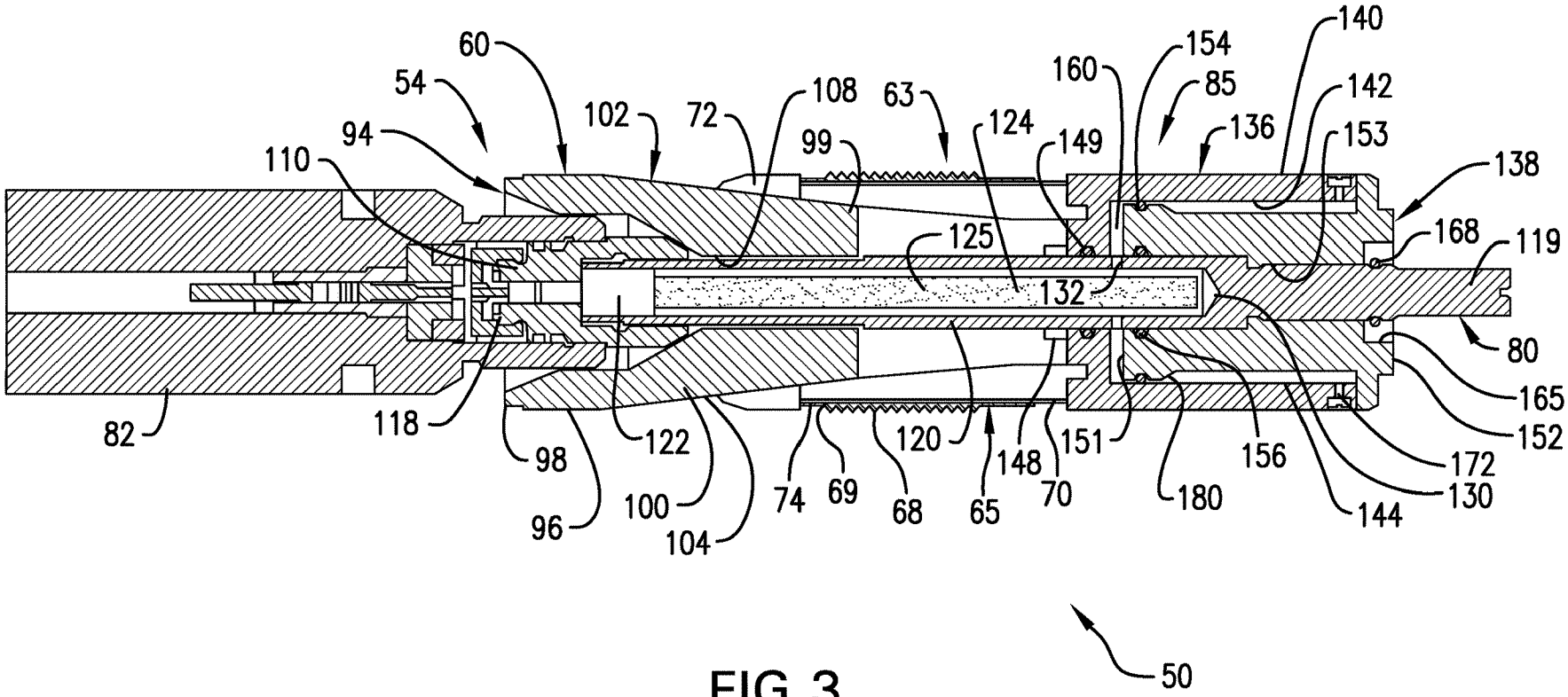
FIG. 3 depicts a cross-sectional view of the frac plug of FIG. 2, in accordance with an aspect of an exemplary embodiment.

Reference will now follow to FIG. 3, with continued reference to FIGS. 1 and 2 in further describing frac plug system 54. Setting cone 60 includes a body 94 having an outer surface 96 including a first end 98, a second end 99, and an intermediate portion 100. A portion of body 94 includes a taper 102. In an embodiment, taper 102 defines a frusto-conical surface 104 that extends from second end 99 toward first end 98. A passage 108 extends through body 94. Passage 108 includes an enlarged diameter portion (not separately labeled) that is receptive to a firing mechanism 110 of actuator head 82. Mandrel 80 extends through passage 108.

Mandrel 80 includes a first end portion 118, second end portion 119, and an intermediate section 120 extending therebetween. A conduit 122 extends through mandrel 80. A first portion (not separately labeled) of conduit 122 defines an actuation chamber 124. Actuation chamber 124 may take the form of a powder charge chamber (not separately labeled) housing power charge 125 that may take the form of an amount of propellant (also not separately labeled) which, when ignited, produces high pressure gases. Conduit 122 terminates at a blind end 130 within mandrel 80. A port 132 extends radially outwardly of conduit 122 through mandrel 80 at intermediate section 120.

In an embodiment, depicted in FIG. 3 bottom sub 85 includes a first member 136 and a second member 138. First member 136 includes an outer surface section 140 and an inner surface section 142 that defines an interior portion 144. First member 136 includes an opening 148 that is receptive of mandrel 80. A seal 149 is arranged in opening 148. Seal 149 seals against an outer surface (not separately labeled) of mandrel 80. Second member 138 includes a first end section 151 and a second end section 152. A shearable thread 153 attaches second member 138 to mandrel 80.

A first seal 154 extends about an exterior (not separately labeled) of second member 138 adjacent first end section 151. First seal 154 seals against inner surface section 142 of first member 136. A second seal 156 extends about an interior passage (not separately labeled) of second member 138. Second seal 156 seals against the outer surface of mandrel 80. A chamber 160 is formed between first end section 151 of second member 138 and an inner axial end wall (not separately labeled) of first member 136.

Second member 138 includes a recess 165 in second end section 152. A frangible element 168 is arranged about second end portion 119 of mandrel 80 in recess 165. Frangible element 168 prevents second member 138 from unthreading from mandrel 80 when pumping downhole tool 50 into wellbore 34.

In an embodiment, frac plug system 54 is introduced into wellbore 34 and moved to a selected depth/position on, for example, wireline 30. Once in position, control system 23 may send a signal to actuator head 82 to activate firing mechanism 110 to set off the amount or propellant in actuation chamber 124. Once ignited, the propellant or other substance produces a pressure wave that may travel down conduit 122 towards second end portion 119. The pressure wave passes through port 132 into chamber 160. The pressure wave causes slip 65 to break into segmented pieces (not separately labeled) allowing first member 136 to travel axially along mandrel 80 driving anchor 63 along setting cone 60.

Anchor 63 expands radially outwardly into contact with annular wall 38. In addition to setting anchor 63, first member 136 drives seal 72 and, in some embodiments, a backup ring (not shown) along setting cone 60. Seal 72 expands radially outwardly into contact with annular wall 38 forming a plug. Once casing wall 38 prevents anchor 63 from expanding pressure applied in chamber 160 will increase until enough axial force is created to break shearable threads 153 and frangible element 168. Once set, downhole tool 50 may be withdrawn. At this point, bottom sub 85 may drop towards a toe (not shown) of wellbore 34. Mandrel 80 along with actuator head 82 may be withdrawn from wellbore 34. A plurality of fasteners, one of which is indicated at 172, keeps first member 136 from separating from second member 138 so that the plug will be easier to mill up.

In another embodiment, actuator head 82 may allow hydrostatic pressure to enter into actuation chamber 124 and chamber 160 to apply a pressure differential against a chamber with atmospheric pressure in bottom sub (not shown) to shift first member 136 upward to set frac plug system 54.

Figure 4:
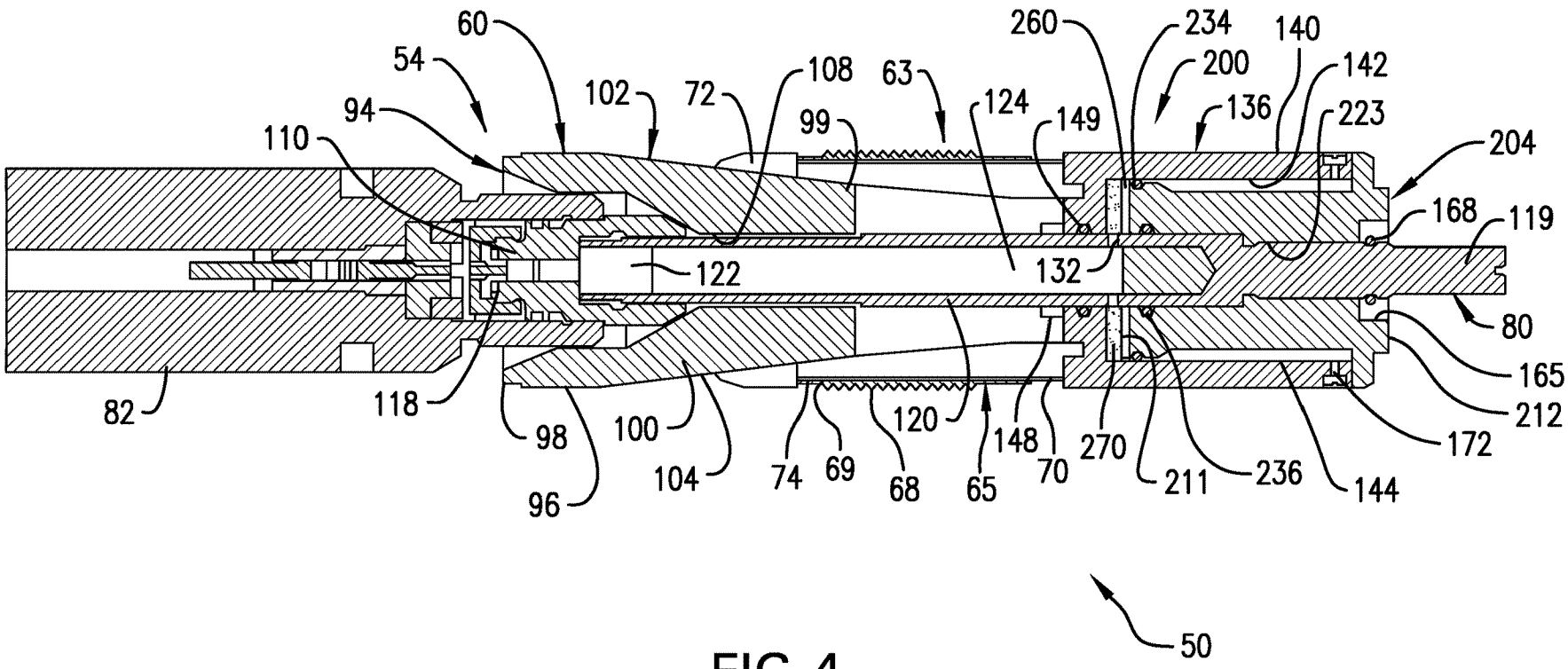
FIG. 4 depicts a cross-sectional view of the frac plug of FIG. 2, in accordance with another aspect of an exemplary embodiment.

Reference will now follow to FIG. 4, wherein like reference numbers present corresponding parts in the respective views, in describing a bottom sub assembly 200 in accordance with another aspect of an exemplary embodiment. Bottom sub assembly 200 includes first member 136 and a second member 204 having a first end section 211 and a second end section 212. A shearable thread 223 attaches second member 204 to mandrel 80. A first seal 234 extends about an exterior (not separately labeled) of second member 204 adjacent first end section 211. First seal 234 seals against inner surface section 142 of first member 136. A second seal 236 extends about an interior passage (not separately labeled) of second member 204. Second seal 236 seals against the outer surface of mandrel 80.

In an embodiment, a chamber 260 is formed between first end section 211 of second member 204 and an inner axial end wall (not separately labeled) of first member 136. In an embodiment, a power charge 270, which could take the form of an amount of propellant, is arranged in chamber 260. Power charge 270 may be operatively connected to firing mechanism 110 of actuator head 82 via actuation chamber 124. In a manner similar to that discussed herein, control system 23 may send a signal to actuator head 82 to activate firing mechanism 110 to ignite power charge 270. Once ignited, power charge 270 produces a pressure that causes slip 65 to break into segmented pieces allowing first member 136 to travel axially along mandrel 80 driving anchor 63 into along setting cone 60.

Anchor 63 expands radially outwardly into contact with annular wall 38. In addition to setting anchor 63, first member 136 drives seal 72, and, in some embodiments, a backup ring (not shown) along setting cone 60. Seal 72 expands radially outwardly into contact with annular wall 38 forming a plug. Once casing wall 38 prevents anchor 63 from expanding pressure applied in chamber 260 will increase until enough axial force is created to break shearable threads 153 and frangible element 168. Once set, downhole tool 50 may be withdrawn. At this point, bottom sub 85 may drop towards a toe (not shown) of wellbore 34. Mandrel 80 along with actuator head 82 may be withdrawn from wellbore 34.

Set forth below are some embodiments of the foregoing disclosure:

Embodiment 1

A downhole tool comprising: a setting cone including a body having an outer surface, the body having a first end, a second end and an intermediate portion, at least a portion of the body including a taper at the second end, a passage extending through the body from the first end to the second end; an anchor arranged at the second end of the setting cone, the anchor including a first end section receptive of the setting cone and a second end section; a mandrel extending through the passage of the setting cone and the anchor, the mandrel including a first end portion, a second end portion and an intermediate section, a conduit extends from the first end portion toward the second end portion, an opening extends from the conduit through the mandrel; and a bottom sub arranged at the second end section of the anchor, the bottom sub including a first member fixedly mounted to the mandrel and a second member that is shiftable relative to the mandrel.

Embodiment 2

The downhole tool according to any previous embodiment, wherein the first member of the bottom sub is spaced from the second member of the bottom sub, the bottom sub including a chamber arranged between the first member and the second member.

Embodiment 3

The downhole tool according to any previous embodiment, further comprising: a firing mechanism arranged at the first end portion of the mandrel.

Embodiment 4

The downhole tool according to any previous embodiment, wherein the opening in the mandrel fluidically connects the conduit and the chamber.

Embodiment 5

The downhole tool according to any previous embodiment, wherein a portion of the conduit defines an actuation chamber.

Embodiment 6

The downhole tool according to any previous embodiment, further comprising: an amount of propellant arranged in the actuation chamber, the amount of propellant being operatively connected to the firing mechanism.

Embodiment 7

The downhole tool according to any previous embodiment, further comprising: a power charge arranged in the chamber defined between the first member and the second member of the bottom sub, the power charge being operatively connected to the firing mechanism through the conduit.

Embodiment 8

The downhole tool according to any previous embodiment, further comprising: one or more fasteners preventing separation between the first member of the bottom sub and the second member of the bottom sub.

Embodiment 9

The downhole tool according to any previous embodiment, further comprising: a frangible element connecting the second end portion of the mandrel and the second member of the bottom sub.

Embodiment 10

The downhole tool according to any previous embodiment, wherein the first member of the bottom sub includes an interior portion, the second member of the bottom sub being selectively arranged in the interior portion of the bottom sub.

Embodiment 11

A resource exploration and recovery system comprising: a first system; and a second system fluidically connected to the first system through a wireline, the wireline supporting a downhole tool comprising: a setting cone including a body having an outer surface, the body having a first end, a second end and an intermediate portion, at least a portion of the body including a taper at the second end, a passage extending through the body from the first end to the second end; an anchor arranged at the second end of the setting cone, the anchor including a first end section receptive of the setting cone and a second end section; a mandrel extending through the passage of the setting cone and the anchor, the mandrel including a first end portion, a second end portion and an intermediate section, a conduit extends from the first end portion toward the second end portion, an opening extends from the conduit through the mandrel; and a bottom sub arranged at the second end section of the anchor, the bottom sub including a first member fixedly mounted to the mandrel and a second member that is shiftable relative to the mandrel.

Embodiment 12

The resource exploration and recovery system according to any previous embodiment, wherein the first member of the bottom sub is spaced from the second member of the bottom sub, the bottom sub including a chamber arranged between the first member and the second member.

Embodiment 13

The resource exploration and recovery system according to any previous embodiment, further comprising: a firing mechanism arranged at the first end portion of the mandrel.

Embodiment 14

The resource exploration and recovery system according to any previous embodiment, wherein the opening in the mandrel fluidically connects the conduit and the chamber.

Embodiment 15

The resource exploration and recovery system according to any previous embodiment, wherein a portion of the conduit defines an actuation chamber.

Embodiment 16

The downhole tool according to any previous embodiment, further comprising: an amount of propellant arranged in the actuation chamber, the amount of propellant being operatively connected to the firing mechanism.

Embodiment 17

The downhole tool according to any previous embodiment, further comprising: a power charge arranged in the chamber defined between the first member and the second member of the bottom sub, the power charge being operatively connected to the firing mechanism through the conduit.

Embodiment 18

The resource exploration and recovery system according to any previous embodiment, further comprising: one or more fasteners preventing separation between the first member of the bottom sub and the second member of the bottom sub.

Embodiment 19

The resource exploration and recovery system according to any previous embodiment, further comprising: a frangible element connecting the second end portion of the mandrel and the second member of the bottom sub.

Embodiment 20

The resource exploration and recovery system according to any previous embodiment, wherein the first member of the bottom sub includes an interior portion, the second member of the bottom sub being selectively arranged in the interior portion of the bottom sub.

The terms "about" and "substantially" are intended to include the degree of error associated with measurement of the particular quantity based upon the equipment available at the time of filing the application. For example, "about" and/or "substantially" can include a range of +8% or 5%, or 2% of a given value.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole tool comprising:

a setting cone including a body having an outer surface, the body having a first end, a second end and an intermediate portion, at least a portion of the body including a taper at the second end, a passage extending through the body from the first end to the second end;

an anchor arranged at the second end of the setting cone, the anchor including a first end section receptive of the setting cone and a second end section;

a mandrel extending through the passage of the setting cone and the anchor, the mandrel including a first end portion, a second end portion and an intermediate section, a conduit extends from the first end portion toward the second end portion, an opening extends from the conduit through the mandrel; and a bottom sub arranged at the second end section of the anchor, the bottom sub including a first member fixedly mounted to the mandrel and a second member that is shiftable relative to the mandrel, wherein the mandrel is selectively separable from the first member of the bottom sub and removeable from the setting cone and the anchor after an anchor setting operation.

2. The downhole tool according to claim 1, wherein the first member of the bottom sub is spaced from the second member of the bottom sub, the bottom sub including a chamber arranged between the first member and the second member.

3. The downhole tool according to claim 2, further comprising: a firing mechanism arranged at the first end portion of the mandrel.

4. The downhole tool according to claim 3, wherein the opening in the mandrel fluidically connects the conduit and the chamber.

5. The downhole tool according to claim 4, wherein a portion of the conduit defines an actuation chamber.

6. The downhole tool according to claim 5, further comprising: an amount of propellant arranged in the actuation chamber, the amount of propellant being operatively connected to the firing mechanism.

7. The downhole tool according to claim 3, further comprising: a power charge arranged in the chamber defined between the first member and the second member of the bottom sub, the power charge being operatively connected to the firing mechanism through the conduit.

8. The downhole tool according to claim 1, further comprising: one or more fasteners preventing separation between the first member of the bottom sub and the second member of the bottom sub.

9. The downhole tool according to claim 1, further comprising: a frangible element connecting the second end portion of the mandrel and the second member of the bottom sub.

10. The downhole tool according to claim 1, wherein the first member of the bottom sub includes an interior portion, the second member of the bottom sub being selectively arranged in the interior portion of the bottom sub.

11. A resource exploration and recovery system comprising:

a first system;

a second system fluidically connected to the first system; and a wireline extending from the first system into the second system, the wireline supporting a downhole tool comprising:

a setting cone including a body having an outer surface, the body having a first end, a second end and an intermediate portion, at least a portion of the body including a taper at the second end, a passage extending through the body from the first end to the second end;

an anchor arranged at the second end of the setting cone, the anchor including a first end section receptive of the setting cone and a second end section;

a mandrel extending through the passage of the setting cone and the anchor, the mandrel including a first end portion, a second end portion and an intermediate section, a conduit extends from the first end portion toward the second end portion, an opening extends from the conduit through the mandrel; and a bottom sub arranged at the second end section of the anchor, the bottom sub including a first member fixedly mounted to the mandrel and a second member that is shiftable relative to the mandrel, wherein the mandrel is selectively separable from the first member of the bottom sub and removeable from the setting cone and the anchor after an anchor setting operation.

12. The resource exploration and recovery system according to claim 11, wherein the first member of the bottom sub is spaced from the second member of the bottom sub, the bottom sub including a chamber arranged between the first member and the second member.

13. The resource exploration and recovery system according to claim 12, further comprising: a firing mechanism arranged at the first end portion of the mandrel.

14. The resource exploration and recovery system according to claim 13, wherein the opening in the mandrel fluidically connects the conduit and the chamber.

15. The resource exploration and recovery system according to claim 14, wherein a portion of the conduit defines an actuation chamber.

16. The downhole tool according to claim 15, further comprising: an amount of propellant arranged in the actuation chamber, the amount of propellant being operatively connected to the firing mechanism.

17. The downhole tool according to claim 13, further comprising: a power charge arranged in the chamber defined between the first member and the second member of the bottom sub, the power charge being operatively connected to the firing mechanism through the conduit.

18. The resource exploration and recovery system according to claim 11, further comprising: one or more fasteners preventing separation between the first member of the bottom sub and the second member of the bottom sub.

19. The resource exploration and recovery system according to claim 11, further comprising: a frangible element connecting the second end portion of the mandrel and the second member of the bottom sub.

20. The resource exploration and recovery system according to claim 11, wherein the first member of the bottom sub includes an interior portion, the second member of the bottom sub being selectively arranged in the interior portion of the bottom sub.

* * * * *